United States Patent [19]

Stankus

[11] Patent Number: 4,911,384

[45] Date of Patent: Mar. 27, 1990

[54] WINGED KITE

[76] Inventor: Marguerite E. Stankus, 2868 W. Landing Rd., Virginia Beach, Va. 23456

[21] Appl. No.: 330,023

[22] Filed: Mar. 28, 1989

[51] Int. Cl.[4] ..... B64C 31/06

[52] U.S. Cl. ..... 244/153 R; 244/154; D21/88

[58] Field of Search ..... 244/153–155; 446/30, 488, 387, 388, 67; D21/88

[56] References Cited

U.S. PATENT DOCUMENTS

| | | | |
|---|---|---|---|
| D. 57,448 | 3/1921 | Shrum . | |
| 72,855 | 12/1867 | Hughes | 244/153 R |
| D. 196,057 | 8/1963 | Levine | D34/15 |
| D. 196,849 | 11/1963 | Koonce | D34/15 |
| 1,299,465 | 4/1919 | Henley | 446/67 |
| 1,378,193 | 5/1921 | Petty | 446/67 |
| 2,349,417 | 5/1944 | Gene | 244/154 |
| 2,442,417 | 6/1948 | Lang | 244/153 R |
| 2,507,777 | 5/1950 | Frey | 244/153 R |
| 3,076,626 | 2/1963 | Andrews | 244/154 |
| 3,110,460 | 11/1963 | Koonce et al. | 244/153 |
| 3,540,149 | 11/1970 | Lowe | 446/67 |
| 3,787,998 | 1/1974 | Kilroy et al. | 446/61 |
| 4,228,977 | 10/1980 | Tanaka | 244/153 |

FOREIGN PATENT DOCUMENTS 511627 10/1930 Fed. Rep. of Germany ..... 446/30

*Primary Examiner*—Galen Barefoot

*Attorney, Agent, or Firm*—Griffin, Branigan & Butler

[57] ABSTRACT

A winged kite (10) comprises an elongated body (12) attached on a bottom side of a flat sheet lift member (14) forming right and left wings (44, 46) and a diverging flat tail (48). An elongated flexible spar extends between respective outer end portions (60, 62) of the right and left wings across the top side of the lift member and a support ring (68) attached to the top side of the lift member at the body supports the body and the lift member from the spar. Leading edge salient portions (70, 72) of the wings curl upwardly about the spar, the amount of curl being substantially affected by wind striking the right and left leading edge salient portions during flight of the kite. A tether is attached only near the front end of the body. The lift member is formed of a main body sheet (40), for forming the wings and tail, and a support sheet (42), which extneds along the tail between the wings to a front end portion of the body. In one embodiment, the body is formed by a single sheet folded on itself with a fold area being attached to the bottom side of the lift member between the wings and the tail.

20 Claims, 3 Drawing Sheets

WINGED KITE

BACKGROUND OF THE INVENTION

This invention relates generally to the art of kites and more particularly to winged kites having shapes of birds, butterflies, insects, angels, winged men, and other flying winged objects.

Although there are a number of winged kites which are intended to look like birds, or the like when flying, most of them do not really resemble such things because tethers therefor are usually attached at two positions along bottom keels thereof, with the kites being thereby held at unnatural angles of attack for birds. In these positions, such kites react to wind in the same general manner as do normally shaped kites, that is, the wind strikes bottom sides thereof driving them upwardly, and away from a person holding a tether. Thus, they do not appear to be "flying" in the manner of a bird or airplane, but rather to be maintaining a "pulling" balance between the tether, and the wind in the manner of a classical kite. It is a primary object of this invention to provide a winged kite which appears to be flying in the manner of a bird or other flying winged object.

Many prior art kites, including winged kites, are quite unstable, tending to dive to the ground either to the left or to the right in gusts of wind. It is an object of this invention to provide a winged kite which is inherently stable even in wind gusts of relatively high velocities.

Yet another difficulty with many prior art kites, especially winged kites, is that it takes strong winds to fly them. Therefore, it is an object of this invention to provide a winged kite which is extremely light and which flies easily in relatively light wind velocities.

Similarly, many prior art kites must be flown extremely high to ensure that there is sufficient steady wind for flying them. Because many birds, such as sea gulls and the like, do not fly high, but rather fly low, such kites do not appear to be flying in normal modes for birds. Therefore, it is an object of this invention to provide a winged kite which can be flown in wind velocities which are both mild and gusty, and therefore can often be flown at very low altitudes. In this regard, it is another object of this invention to provide a winged kite which can fly unattended from a short tether attached to a stationary pole.

SUMMARY

According to principles of this invention, a winged kite comprises an elongated body attached to a bottom side of a flat sheet lift member forming right and left wings and a tail. An elongated flexible spar extends across the top of the wings and is anchored at end portions of the wings. Left and right leading edge salients of the wings curl upwardly about the spar to provide stability and cause wing movement of the winged kite. The lift member is formed of a main-body sheet which forms the wings and the tail and a support sheet attached on top of the main body sheet extending along the tail between the wings to the front end of the body. The body is formed of a sheet folded on itself with the two sides of the folded sheet being adhered together at a front, or head, end to form a narrow front end but being held apart at a back end by a large portion of a fold area being adhered to the bottom side of the lift member. Leading edge loops positioned at the left and right leading edge salient portions loop about the elongated spar.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

BRIEF DESCRIPTION OF THE PREFERRED EMBODIMENT

Figure 1:
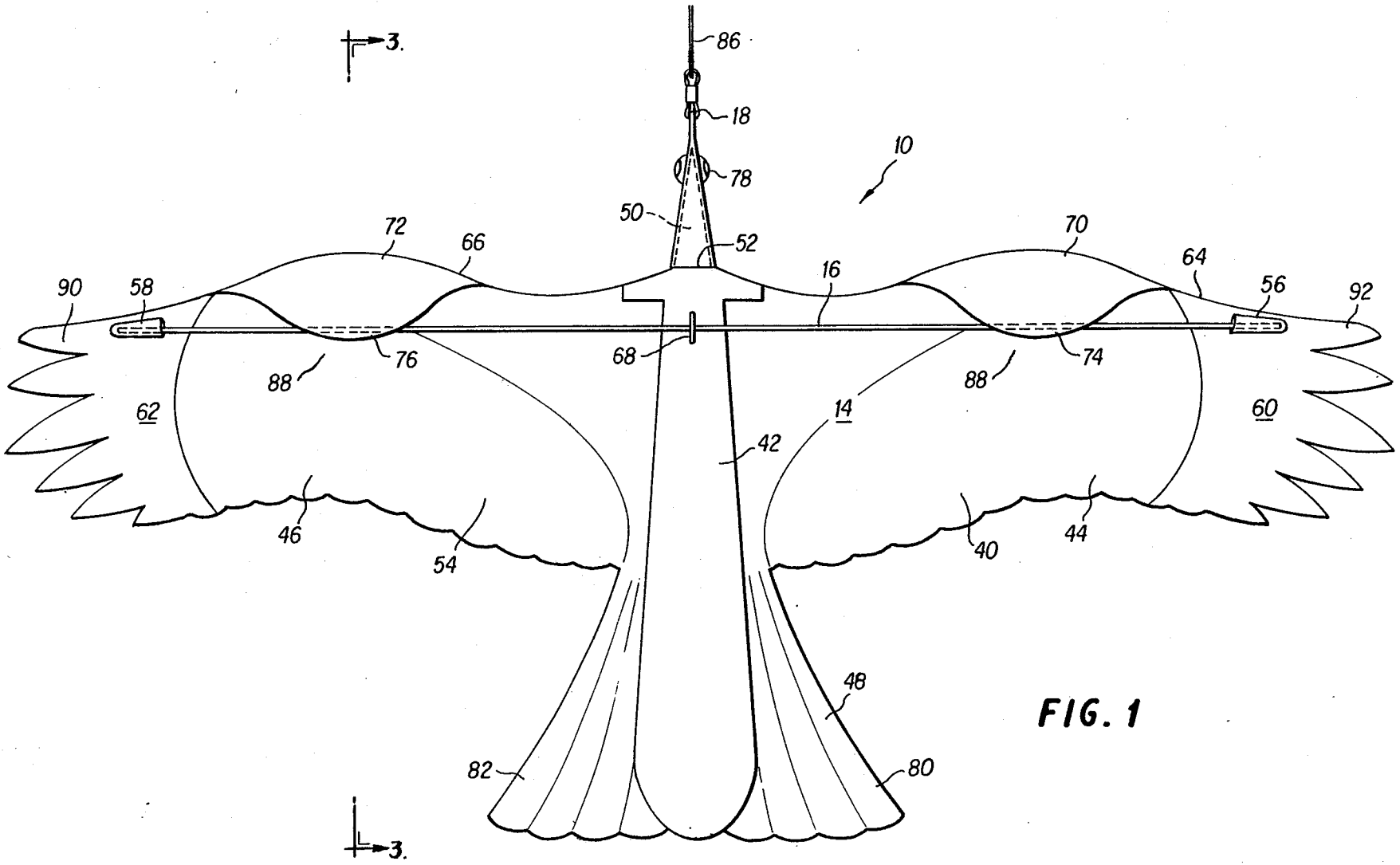
FIG. 1 is a top plan view of a winged kite of this invention with a lift member being flat so that its shape can be seen.

A winged kite 10 includes generally an elongated body 12 a lift member 14, and an elongated flexible spar 16.

In the preferred embodiment, the elongated body 12 has front and rear ends 18 and 20 and bottom, top, right and left sides 22, 24, 26, and 28 respectively. The elongated body 12 is formed of a single sheet of spunbonded olefin whose folded area at the top side 24 is attached by an adhesive to a bottom side 30 of the lift member 14. The front end 18 of the body 12 is quite thin, as can be seen FIG. 1, it being formed by adhering the right and left sides 26 and 28 of the folded sheet forming the body 12 together. However, at the rear end 20 of the elongated body 12, the right and left sides 26 and 28 are held apart to form a rather wide cavity 32. The body 12 is held in this configuration by having a larger portion of the folded area, or top side 24, of the body attached to the bottom side of the lift member 14 at the rear end 20 than is attached to the lift member 14 nearer the front end 18. Talons 34 are attached to the bottom side 22 of the body by means of thread pivots 36, or the like, which hold a fish 38, the talons 34 and the fish 38 being formed of sheets of spunbonded olefin. The talons 34 and the fish 38 are mainly for aesthetics and are not essential for flying the winged kite 10.

The lift member 14 is formed of a lower, main-body sheet 40 and an upper, support sheet 42. Both the main-body sheet 40 and the support sheet 42 are formed of spunbonded olefin, although the support sheet 42 might appear to be of a thicker gauge than the main-body sheet 40 because it coincides with two other layers. The main-body sheet 40 forms right and left wings 44 and 46 and a tail 48. It should be noted that the main-body sheet 40 can be formed of one sheet of material, although it can also be formed of right and left sides attached together where necessary. The support sheet 42 is mostly adhered to a top side of the main-body sheet 40 and is elongated to extend along the flat tail 48, between the right and left wings 44 and 46, and finally with a forward portion 50 thereof, through a slit 52 in the top side 24 of the elongated body 12. Thus, the support sheet 42 provides extra support along a line from the rear of the tail 48 to the front end 18 of the elongated body 12. Although the support sheet 42 is adhered mainly to a top side 54 of the main-body sheet 40, the forward portion 50 thereof is adhered to the bottom side 30 of the main-body sheet 40.

In a preferred embodiment, left and right wing tip portions 90 and 92 have reinforcing sheets adhered thereto.

The spar 16 is constructed of flexible fiberglass with its outer ends being placed into right and left anchor pockets 56 and 58 on top sides of outer end portions 60 and 62 respectively of the right and left wings 44 and 46, near right and left leading edges 64 and 66 thereof. A support ring 68 is attached to the lift member 14 and the elongated body 12 at the support sheet 42 between the right and left anchor pockets 56 and 58 and the spar 16 passes through this support ring 68. The right and left leading edges 64 and 66 of the right and left wings 44 and 46 are shaped such that they form right and left leading edge salient portions 70 and 72 positioned forwardly of the spar 16, while most of the remainder of the wings is positioned rearwardly of the spar 16. During flight, these right and left leading edge salient portions 70 and 72 curl upwardly and backwardly about the spar 16, as can be seen in both FIGS. 2 and 3.

Right and left leading edge retainer loops 74 and 76 extend rearwardly from the right and left leading edges 64 and 66 to attach to the top side 54 of the lift member 14 behind the spar 16. Thus, the right and left leading edge retainer loops enclose the spar 16.

Plastic eyes 78 near the front end 18 of the body 12 are for aesthetics, contributing to the winged kite of the preferred embodiment having an appearance of an Osprey, otherwise known as a Sea Eagle or Fish Hawk.

Figure 2:
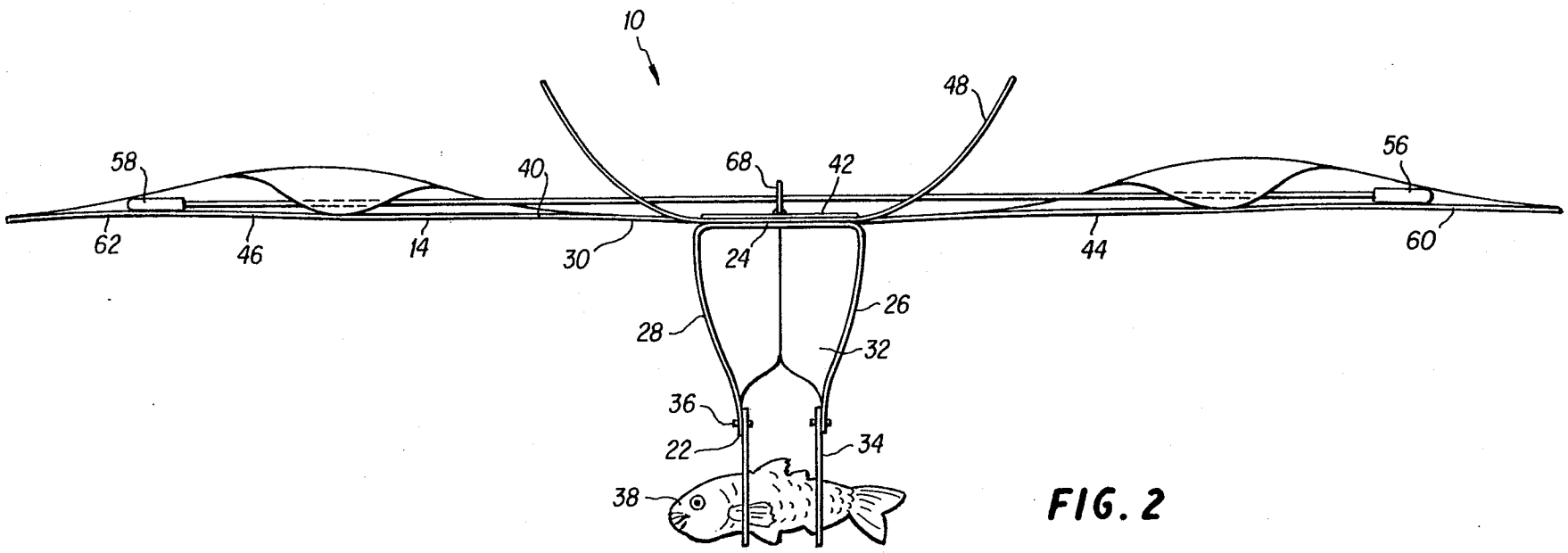
FIG. 2 is a rear end view of the winged kite of FIG. 1, but in a flying mode, with left and right tail sides being curled upwardly by wind and left and right leading edge salient portions of wings being curled upwardly by prestressing and wind.
Figure 3:
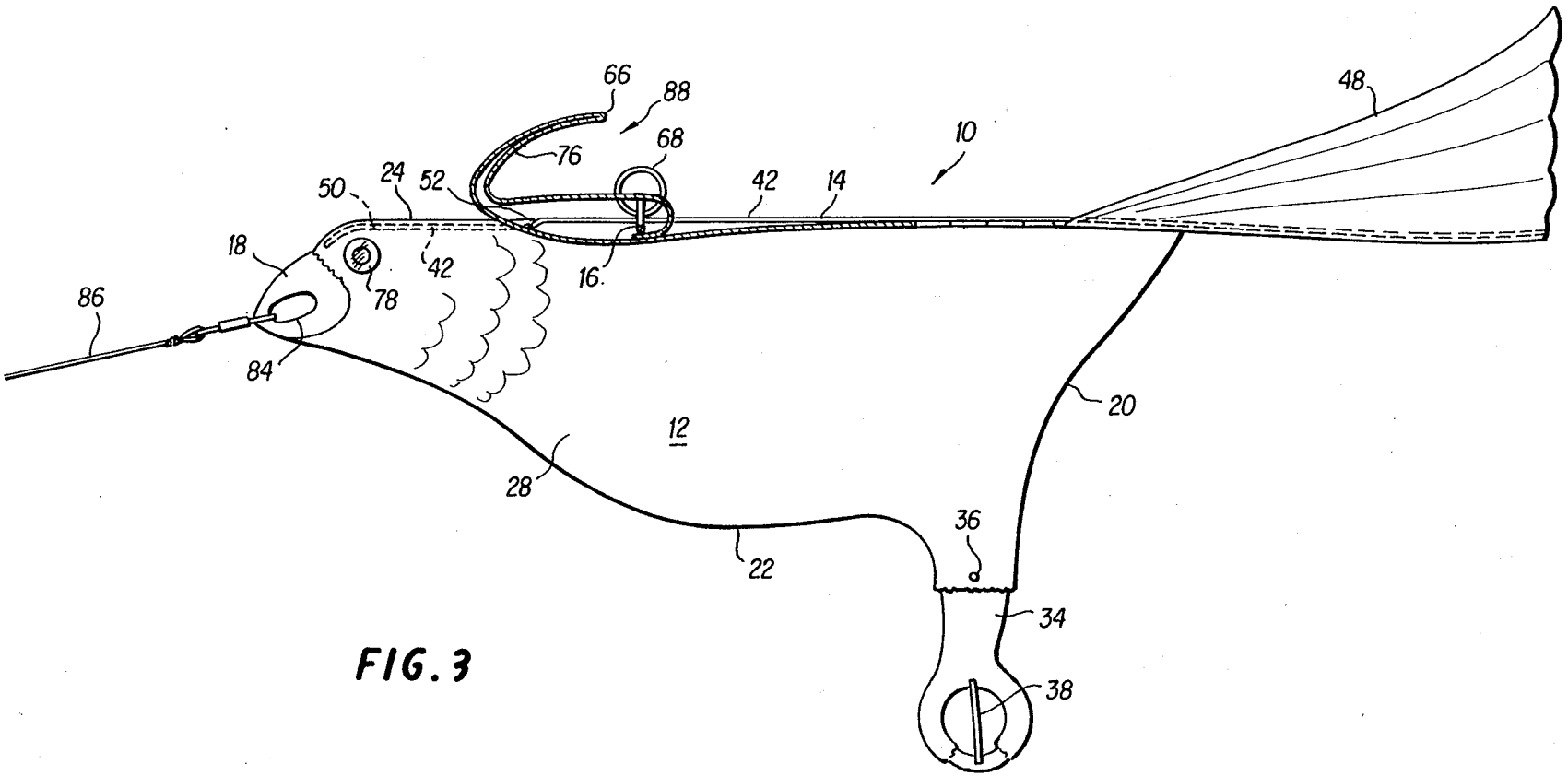
FIG. 3 is a cross sectional view taken on line 3—3 in FIG. 1.

Right and left tail sides 80 and 82 flare outwardly in a rearward direction, as can be seen in FIG. 1. When the winged kite 10 flies, the right and left tail sides 80 and 82 tend to bow upwardly as is shown in FIG. 2.

The elongated body 12 defines a tether opening 84 near the front end 18 thereof through which a tether 86 is attached. In a preferred embodiment such attachment is accomplished by using a swivel (not shown) such as a ball bearing swivel of the type used for fastening a fishing lure to a fishing line.

In operation, the winged kite 10 is sold and delivered to a customer in a rolled-up or folded-up condition, with the spar 16 not being mounted in the right and left anchor pockets 56 and 58 as is shown in FIG. 1. Since the winged kite 10 is constructed almost exclusively of flexible sheet material with the exception of the spar 16, it can be easily folded or rolled up for packaging. An owner spreads out the right and left wings 44 and 46 and shapes the elongated body 12 to be as shown in the drawings and flexes the spar 16 so that it can be placed through the support ring 68 and the right and left leading edge retainer loops 74 and 76 and its ends are placed in the right and left anchor pockets 56 and 58. In one embodiment, ends of the spar 16 (not shown) have resilient, dull, pieces thereon in order to prevent them from tearing the right and left anchor pockets 56 and 58. The tether 86 is attached using a swiveled bridle (not shown) at the tether opening 84. Before flying the kite, one bends by hand the right and left leading edge salient portions 70 and 72 upwardly and backwardly about the spar 16 so as to prestress them somewhat in the positions shown in FIG. 2 and FIG. 3, however, in FIG. 3 this is shown to be somewhat in the extreme for illustrative purposes. This will tend to form wing hollows 88 behind the salient portions 70 and 72. If these wing hollows 88 are formed unevenly, the winged kite may fly with one wing slightly lower for a while. It is possible to place a paper clip at an end of the wing which is here until the hollows form evenly for both right and left leading edge salient portions 70 and 72. In this regard, the hand prestressing of the salient portions 70 and 72 is not a final prestressing of these members into their proper attitudes. Rather, when the kite is flying, the wind affects these portions greatly and automatically prestresses them to their proper positions. Eventually, the right and left leading edge salient portions 70 and 72 remember their proper shapes. As the wind pushes the salient portions backwardly, the salient portions are tensioned to pull slack out of the wings, which causes the wings to be slightly concaved upwardly behind the salient portions, thereby accentuating the hollows.

An exciting way to fly the winged kite of this invention is to attach it to light weight line of a fishing rod (rod flying). Because the winged kite flies in such a light wind, it can be flown on as little as ten feet of line. Normally, kites do not fly well in variable and gusty winds, however, the winged kite of this invention flies wonderfully in such conditions. In fact, such conditions make the winged kite of this invention appear to be even more bird-like than under other conditions. In this regard, the kite actually appears to flap its wings and to soar to a new position and then flap its wings again and soar to another position. In fact, a rod flown, or pole flown, kite will fly itself if the pole is held in a stationary position. When the kite is tethered to a wharf at the seashore it can easily be confused for a Fish Hawk.

Although operation of the upwardly curled right and left leading edge salient portions 70 and 72 is not fully understood, it is thought that these members add stability to the kite, flexing with the wind, to correct improper positions of the kite, thereby preventing it from soaring downwardly too far in one direction or the other. Also, it is thought that these members provide an appropriate lift required for the kite.

It can be appreciated by those of ordinary skill in the art that by attaching a tether only to a beak, or front end, of the elongated body 12 of the kite, the kite actually flies parallel to the ground in the manner of a bird or airplane rather than merely serving as a balancing member between a tether and the wind as do most kites. That is, the kite remains much more horizontal than most kites.

While the invention has been particularly shown and described with reference to a preferred embodiment, it will be understood by those skilled in the art that various changes in form and detail may be made therein without departing from the spirit and scope of the invention. For example, it would be possible to make kites of this invention resembling birds other than Ospreys and it would also be possible to utilize the principles of this invention for forming other flying winged objects. Also, in some embodiments additional sheets are adhered to those sheets described herein as reinforcing for various members of the kite, for example at wing tips thereof. It would be possible to construct the body 12 of two sheets, one on each side of the kite.

The embodiments of the invention in which an exclusive property or privilege are claimed are defined as follows:

1. A winged kite for being lifted and held from a ground surface by wind, said kite comprising:

an elongated body having front and rear ends and top, bottom, right and left sides;

a flat, sheet, lift member having top and bottom sides, the bottom side of said lift member being attached to the top side of said elongated body, said lift member having a shape such that it forms flat right and left wings extending laterally outwardly from respective right and left sides of said body and a flat tail extended outwardly beyond the rear end of said body;

an elongated flexible spar extending between respective outer end portions of said right and left wings across the top side of said lift member with opposite ends of said spar being anchored to said right and left wings at outer end portions;

said right and left wings each including a leading edge portion positioned substantially forwardly of said spar, said leading edge portions curling upwardly about said spar, said leading edge portions being constructed of flexible sheet material said leading edge portions including means having a sufficient rigidity and bending memory for being prestressed into said curled position about said spar and for holding said curled prestressed positions during flight but being sufficiently flexible such that the amount of curl about said spar is substantially affected by wind during flight of said kite; and a tether attachment means for attaching a tether to said elongated body forwardly of said wings near the front end thereof for restraining said kite during flight thereof while it is being lifted and held from a ground surface by the wind.

2. A winged kite as in claim 1 wherein, said tail includes side edges which diverge outwardly in a rearward direction.

3. A winged kite as in claim 1 wherein, said lift member is formed of two sheets, a main-body sheet forming said wings and said tail and an elongated support sheet attached to the main-body sheet along the tail and between said wings.

4. A winged kite as in claim 3 wherein, said support sheet material is of the same gauge material as said main-body sheet.

5. A winged kite as in claim 4 wherein, a forward portion of said support sheet extends to a front end portion of said body which is located forwardly of leading edges of said wings and is attached thereto.

6. A winged kite as in claim 5 wherein, said body is hollow and said forward portion of said support sheet is located inside said body.

7. A winged kite as in claim 6 wherein, said body is formed by folding a body sheet on itself, with a fold area being attached to the bottom side of the lift member between the wings, at the tail.

8. A winged kite as in claim 7 wherein, the front end of said body is thin, being formed by front edges of said body sheet being adhered together, but wherein said rear end of said body is relatively wide with rear edges being held apart by a larger portion of the fold area at the rear end of the elongated body being adhered to the bottom side of the lift member than is adhered to the lift member nearer the front end of the body.

9. A winged kite as in claim 1 wherein, there is only one tether attachment means and it is near the front end of said body.

10. A winged kite as in claim 1 wherein, said body is formed by folding a body sheet on itself, with a fold area being attached to the bottom side of the lift member between the wings and the tail.

11. A winged kite as in claim 10 wherein, the front end of said body is thin, being formed by front edges of said body sheet being adhered together, but wherein said rear end of said body is relatively wide with rear edges being held apart by a larger portion of the fold area at the rear end of the elongated body being adhered to the bottom side of the lift member than is adhered to the lift member nearer the front end of the body.

12. A winged kite as in claim 11 wherein, said lift member is formed of two sheets, a main-body sheet forming said wings and said tail and an elongated support sheet attached to the main-body sheet along the tail and between said wings.

13. A winged kite as in claim 1 wherein, said leading edge portions of said wings are in the shape of salients protruding outwardly from the rest of the leading edges of the wings.

14. A winged kite as in claim 1 wherein are further included retainer loops positioned at said leading edge portions extending about the spar.

15. The winged kite as in claim 1 wherein is further included a support means attached to the top side of said flat sheet lift member and engaging a center portion of said spar for supporting said body from said spar.

16. A winged kite as in claim 1 wherein all portions of said elongated body have freedom of movement relative to said elongated flexible spar.

17. A winged kite as in claim 1 wherein said elongated boy is constructed of sheet material, there being no spar therein.

18. A winged kite for being lifted and held from a ground surface by wind, said kite comprising:

an elongated body having front and rear ends and top, bottom, right and left sides;

a flat, sheet, lift member having top and bottom sides, the bottom side of said lift member being attached to the top side of said elongated body, said lift member having a shape such that it forms flat right and left wings extending laterally outwardly from respective right and left sides of said body and a flat tail extended outwardly beyond the rear end of said body;

an elongated flexible spar extending between respective outer end portions of said right and left wings across the top side of said lift member with opposite ends of said spar being anchored to said right and left wings at outer end portions;

said right and left wings each including a leading edge portion positioned substantially forwardly of said spar, said leading edge portions curling upwardly about said spar, said leading edge portions being constructed of flexible sheet material such that the amount of curl about said spar is substantially affected by wind during flight of said kite;

a tether attachment means for attaching a tether to said elongated body near the front end thereof for restraining said kite during flight thereof while it is being lifted and being lifted and held from a ground surface by the wind;

wherein, said body is hollow and wherein a forward portion of said support sheet is located inside said body.

19. A winged kite as in claim 18 wherein said body is formed by folding a body sheet on itself, with a fold area being attached to the bottom side of the lift member between the wings, at the tail.

20. A winged kite as in claim 19 wherein, the front end of said body is thin, being formed by front edges of said body sheet being adhered together, but wherein said rear end of said body is relatively wide with a rear edges being held apart by a larger portion of the fold area at the rear end of the elongated body being adhered to the bottom side of the lift member than is adhered to the lift member nearer to the front end of the body.

* * * * *